US005838282A

United States Patent [19]

Lalezari et al.

[11] Patent Number: 5,838,282

[45] Date of Patent: Nov. 17, 1998

[54] MULTI-FREQUENCY ANTENNA

[75] Inventors: Farzin Lalezari, Louisville; J. Mark Rogers, Golden; Ajay I. Sreenivas, Niwot, all of Colo.

[73] Assignee: Ball Aerospace and Technologies Corp., Broomfield, Colo.

[21] Appl. No.: 621,069

[22] Filed: Mar. 22, 1996

[51] Int. Cl.[6] ..... H01Q 21/28

[52] U.S. Cl. ..... 343/727; 343/700 MS; 343/797; 343/853; 343/895

[58] Field of Search ..... 343/700 MS File, 343/725, 727, 797, 799, 844, 853, 893, 895; 4/11; H01Q 21/20, 21/22, 21/26, 21/28

[56] References Cited

U.S. PATENT DOCUMENTS

| | | | |
|---|---|---|---|
| 3,747,111 | 7/1973 | Fletcher et al. | 343/797 |
| 4,329,689 | 5/1982 | Yee | 343/700 MS |
| 4,605,932 | 8/1986 | Butscher et al. | 343/700 MS |
| 4,962,383 | 10/1990 | Tresselt | 343/700 MS |
| 5,220,334 | 6/1993 | Raguenet et al. | 343/727 |
| 5,258,771 | 11/1993 | Praba | 343/895 |
| 5,300,936 | 4/1994 | Izadian | 343/700 |
| 5,434,580 | 7/1995 | Raguenet et al. | 343/725 |

*Primary Examiner*—Michael C. Wimer
*Attorney, Agent, or Firm*—Sheridan Ross P.C.

[57] ABSTRACT

The present invention relates to an antenna system which is capable of multiband operation from a single antenna aperture. The system provides a high degree of design freedom for achieving desired antenna pattern shapes for all relevant frequency bands. The system achieves this pattern shaping ability by utilizing a unique array configuration which is highly adaptable. The array configuration may include a center array element for each of the relevant frequency bands. In one embodiment of the present invention, a dual frequency band antenna is provided which includes a stacked patch element as the center element in a first frequency band and a crossed dipole element, mounted on top of the stacked patch, as the center element in the second frequency band.

41 Claims, 8 Drawing Sheets

MULTI-FREQUENCY ANTENNA

FIELD OF THE INVENTION

The invention relates in general to multiband antenna systems and, more particularly, to antenna systems having multiple antenna arrays in a single aperture, wherein each array is adapted for operation in a different frequency range.

BACKGROUND OF THE INVENTION

Satellite communications systems are systems which utilize artificial satellites (i.e., communications satellites) to provide communications services on earth. These services may include, for example, providing a two-way communications link between two geographically separated locations on earth, such as in a telephone system, or providing an indication of current location, such as in a Global Positioning System (GPS). Communications satellites normally include antenna systems and transmit/receive circuitry for communicating with similarly equipped entities on earth. Because the communications are commonly two-way, multi-frequency communications schemes are normally used where the uplink frequency (i.e., the frequency of the signal being transmitted from the ground station to the satellite) is different from the downlink frequency (i.e., the frequency of the signal being transmitted from the satellite to the ground station). Therefore, communications satellites generally require antenna systems which operate in multiple frequency bands.

Because communications satellites generally have limited size, weight, and payload space, antenna systems on these satellites must be as lightweight and compact as possible. For this reason, it is desirable that satellite antenna systems be capable of multiband operation from within a single aperture. A single-aperture multiband antenna saves space over a side-by-side antenna arrangement. In addition, a single-aperture antenna weighs less because a common support structure is used for the antennas at each of the frequencies.

The ground coverage pattern (i.e., footprint) of a satellite antenna system defines the area on the earth's surface to which signals may be delivered and/or from which signals may be received using that antenna system. Different satellite communications applications, therefore, require different ground coverage patterns (i.e., each application has an optimal ground coverage pattern). In addition, the optimal ground coverage pattern for the transmit mode of a particular application may be different from the optimal pattern for the receive mode. For example, a telephone system utilizing a communications satellite may require a narrow ground coverage pattern, in both receive and transmit mode, for communication between the antenna system and a single ground station on earth. A television broadcast satellite, on the other hand, can require a narrow ground coverage pattern for receiving television signals from earth and a broad ground coverage pattern for broadcasting these signals to all of the homes in a certain region. It is important that an antenna's actual ground coverage pattern be close to the optimal pattern for the application for which the antenna will be used. If the actual pattern is too broad, for example, a signal transmitted by the satellite may create unnecessary interference on earth. Also, an overly broad pattern wastes energy by illuminating areas on the earth's surface which are not meant to receive a signal. Conversely, a pattern which is too narrow can result in the unavailability of a signal in a region which is supposed to receive it.

The actual ground coverage pattern that will be produced by a particular antenna is a function of, among other things, the antenna's radiation pattern (i.e., the shape of the transmit and/or receive beam of the antenna). Therefore, in order to create a desired ground coverage pattern, it is necessary to have a certain degree of control over the antenna's radiation pattern. Techniques do exist for shaping the radiation pattern of an antenna operating at a single frequency. However, beam shaping is made more complicated when attempting to shape the beams for two independent antenna systems sharing a common aperture.

Therefore, a need exists for a multiband/single aperture antenna system which provides a high degree of design freedom for achieving desired pattern shapes in all relevant frequency bands.

SUMMARY OF THE INVENTION

The present invention relates to a multiband antenna system which provides a high degree of design freedom for achieving desired antenna pattern shapes, in all relevant frequency bands, from a single antenna aperture. The system achieves this pattern shaping ability by utilizing a unique array configuration which is highly adaptable. The system may be produced as a lightweight, compact unit and, therefore, has broad application in satellite communications systems. The system also has application in land based communications systems which utilize multiple frequency bands.

In general, the antenna system of the present invention includes at least two separate arrays of antenna elements having a common or overlapping aperture. As used herein, the word "aperture" refers to a portion of a plane surface near an antenna through which a major part of the radiation would pass were the antenna being used in a transmit mode. Each of the separate arrays in the antenna system are adapted for operation in a separate frequency band and, as such, include radiating elements tuned for that frequency band.

In a first aspect of the present invention, a multiband antenna system is provided. The antenna system includes a first array of antenna elements operative in a first frequency range and a second array of antenna elements operative in a second frequency range. Both the first array and the second array include central elements which are substantially coaxially aligned with one another. The first array and the second array also include a first antenna aperture and a second antenna aperture, respectively, wherein the first antenna aperture and the second antenna aperture are at least partially overlapping. The first and second frequency bands are determined based on the particular application in which the antenna system is being implemented. Normally, one of the frequency bands will be associated with a satellite uplink or crosslink and the other with a satellite downlink or crosslink. For example, in a preferred embodiment, the first frequency band is UHF and is associated with a satellite crosslink and the second frequency band is L-band and is associated with a satellite downlink.

The first and second arrays may each include any type of radiating element which is capable of operating in the respective frequency range. The radiating elements may be capable of transmitting/receiving linearly, circularly, or elliptically polarized waves. In addition, the first and second arrays may each include more than one type of radiating element. For example, in a preferred embodiment, the first array includes a stacked patch antenna element and a plurality of quadrafilar helical elements. The element types chosen for a particular array depend on the overall antenna pattern desired for the array.

The inclusion of a central antenna element in both the first and second array improves the system's ability to achieve desired antenna patterns in each of the frequency ranges. By having the central elements coaxially aligned, beams produced by the first and second array can be coaxially aligned and the overall space taken up by the antenna system can be minimized.

One way of creating coaxially aligned central elements in accordance with the present invention is by mounting the central element of the second array upon the top of the central element of the first array. For example, the central element of the first array can include a stacked patch element having an upper conductive plate and a lower conductive plate. The central element of the second array can be mounted upon the top of the upper conductive plate of the stacked patch, using it as a ground plane. The central element of the second array may include, for example, a crossed dipole radiating element.

In addition to the central elements, the first and second. arrays may each include any number of separate ring arrays situated about their respective central element, the ring arrays each including a separate plurality of radiating elements. The ring arrays are preferably concentric with their respective central element for creating a substantially circularly symmetrical antenna beam. In addition, the ring arrays are preferably circular in shape, although other symmetrical shapes, such as ellipses, may be utilized.

The system may also include separate beamforming networks feeding each of the arrays. Preferably, each beamforming network is adapted to feed the elements of its respective array according to a predetermined excitation ratio. For example, a beamforming network associated with the first array can be configured to feed the first central element at a first power level and the elements of the first plurality of antenna elements (i.e., the first ring array) at a second power level. The particular power levels used are those determined to produce a desired antenna pattern. The beamforming network may operate similarly in a receive mode. The beamforming network for a particular array may also be capable of feeding the central element of the array at a different phase than the elements of an associated ring array. The phase difference used is also that determined to achieve a desired antenna pattern.

In another aspect of the present invention, a multifrequency antenna is provided comprising a first array of antenna elements for operation in a first frequency range and a second array of antenna elements for operation in a second frequency range. The first array and the second array each have an associated antenna aperture and both of these antenna apertures are partially overlapping. The first array includes a first group of elements and a second group of elements, wherein antenna elements in the first group have a gain greater than those in the second group. The types of elements which may be used in the first and second arrays have been described above. The first and second frequency ranges preferably do not overlap.

The multifrequency antenna is capable of achieving a desired antenna pattern from the first array of elements by properly choosing the gain values and locations of the elements in the first and second groups of the first array. The antenna may also include multiple groups of antenna elements in the second array of antenna elements which provides similar pattern shaping capabilities for the second array. Both the first array of elements and the second array of elements may include a central element for providing even further pattern shaping capability. Preferably, the center element in a particular array is part of the element group having the higher antenna gain.

In another aspect of the present invention, a center unit for use in enhancing the beam shaping capabilities of a multifrequency antenna having both a first antenna array for use in a first frequency range and a second antenna array for use in a second frequency range is provided. More specifically, the center unit comprises: a stacked patch antenna element capable of operation in the first frequency range, the stacked patch antenna element including an upper conductive plate and a lower conductive plate; and a second antenna element capable of operation in the second frequency range, the second antenna element mounted upon an upper surface of the upper conductive plate and using the upper conductive plate as a ground plane. The types of antenna elements which may be used in the first and second arrays have been described above.

The second antenna element may include a single element or a plurality of antenna elements arranged upon the upper conductive plate. If a plurality of elements is used, the plurality may include multiple types of elements. In a preferred embodiment, a plurality of crossed dipole antenna elements, implemented in microstrip transmission line are utilized as the plurality of antenna elements. The plurality of elements may include a first ring array disposed upon the upper conductive plate and substantially centered on said plate and/or a central element substantially centered on said plate. If the second antenna element includes only a single element, it is preferred that the single element be substantially coaxially aligned with the stacked patch antenna element.

The second antenna element may include, for example a dipole antenna element. The dipole antenna element may be partially air loaded to reduce the weight of the antenna and may also be adapted for easy removal and replacement to aid in the testing of the antenna. The dipole antenna element may include a crossed dipole element. The crossed dipole antenna element may include a feed structure having a hybrid coupler and/or a balun for use in exciting said crossed dipole element.

The upper conductive plate of the stacked patch is preferably mounted parallel to the lower conductive plate with a uniform spacing therebetween. The spacing is filled with a dielectric material which, for weight purposes, is preferably air. The stacked patch may be directly fed at either plate or at both plates. The stacked patch may also include more than two plates. The elements in the plurality of elements on top of the upper conductive plate may be fed from below through an opening in the plates of the stacked patch. This feed arrangement results in a more compact and lighter antenna. In addition, a divider/combiner means for use in feeding the elements in the plurality may be mounted upon the top of the upper conductive plate to provide an even more compact unit. This divider/combiner unit may be implemented in microstrip transmission line and may use the upper conductive plate as a ground plane.

DETAILED DESCRIPTION

The present invention relates to a multiband antenna system which provides a high degree of design freedom for achieving desired antenna pattern shapes, in all relevant frequency bands, from a common antenna aperture. The system achieves this pattern shaping ability by utilizing a unique array configuration which is highly adaptable. The system may be produced as a lightweight, compact unit and, therefore, has broad application in satellite communications systems. The system also has application in land based communications systems which utilize multiple frequency bands.

Figure 1:
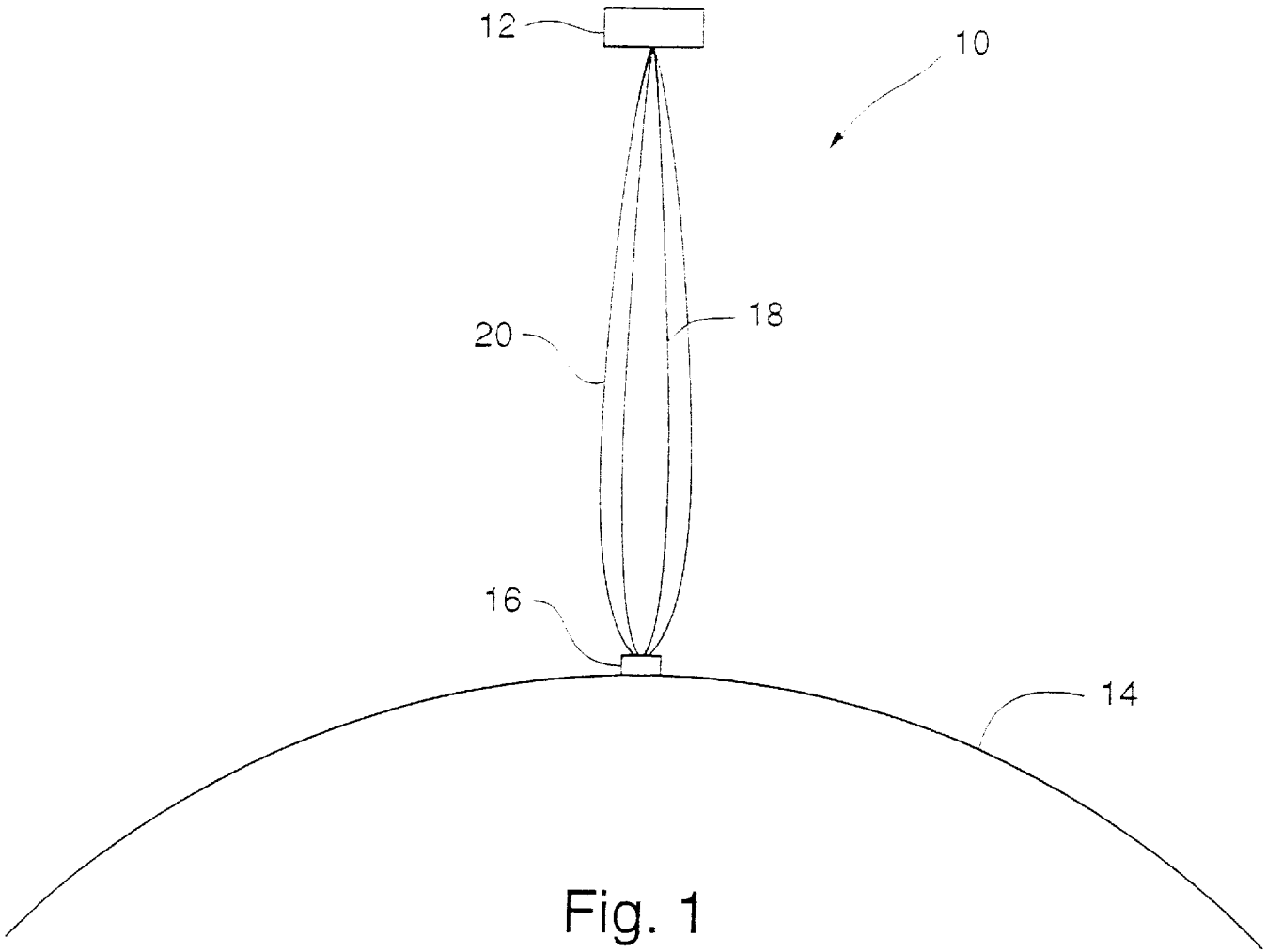
FIG. 1 is a diagram illustrating a satellite communications system which may utilize the antenna system of the present invention.

FIG. 1 illustrates a satellite communications system 10 which may utilize the antenna system of the present invention. The system 10 includes: a communications satellite 12 in orbit about the earth 14 and a ground station 16 which communicates with the satellite 12 using electromagnetic radiation. The system 10 may be used in any one of a number of different communications applications. For example, the system 10 can be part of a telephone communications system, in which case the ground station 16 can include a telephone switching office attempting to connect to another remote office via the satellite. Alternatively, the system 10 can be part of a Global Positioning System (GPS), in which case the ground station 16 can include a military vehicle trying to determine its current location on earth.

For applications requiring two-way communication between the satellite 12 and the ground station 16, both the satellite 12 and the ground station 16 must include transmit/receive (T/R) circuitry (not shown) and an antenna system (not shown). As discussed previously, two-way satellite communications normally uses different frequency bands for the uplink and the downlink. Using a multiband scheme allows transmission and reception in a satellite antenna to occur simultaneously without interference. As illustrated in FIG. 1, the antenna system of the satellite 12 must be capable of producing a transmit beam 18 at the downlink frequency for delivering signals to the ground station 16 and a receive beam 20 at the uplink frequency for receiving signals from the ground station 16. The optimal shape of the two beams will depend upon the specific application which is being implemented.

Figure 2:
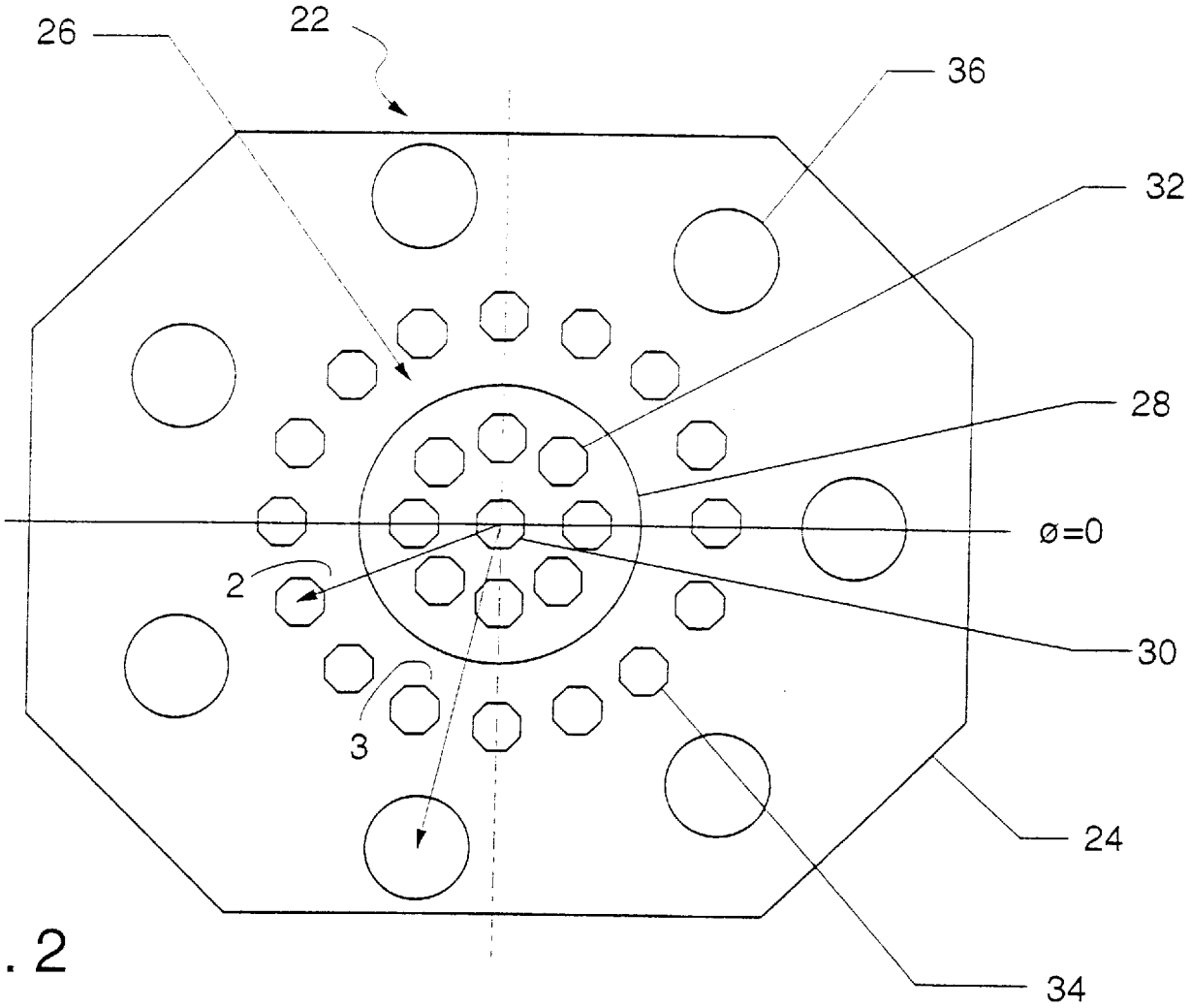
FIG. 2 is a top view of an antenna system in accordance with the present invention.

FIG. 2 is a front view of an antenna system 22 in accordance with the present invention. The antenna system 22 may be used, for example, in the Satellite 12 in System 10 of FIG. 1. In the preferred embodiment, the system 22 uses L-band as its downlink frequency band and UHF as its crosslink frequency band. The system 22 comprises: a support plate 24; a center unit 26 including a center UHF element 28, a center L-band element 30, and a plurality of L-band elements forming an inner L-band ring array 32 about center L-band element 30; a plurality of L-band elements forming an outer L-band ring array 34 about the center unit 26; and a plurality of UHF elements forming a UHF ring array 36 about the center unit 26. All of the L-band elements in the system 22 operate collectively to create a single transmit beam for communication with a remote entity. Similarly, all of the UHF elements operate collectively to create a single receive beam for receiving signals from a remote entity.

Figure 3A:
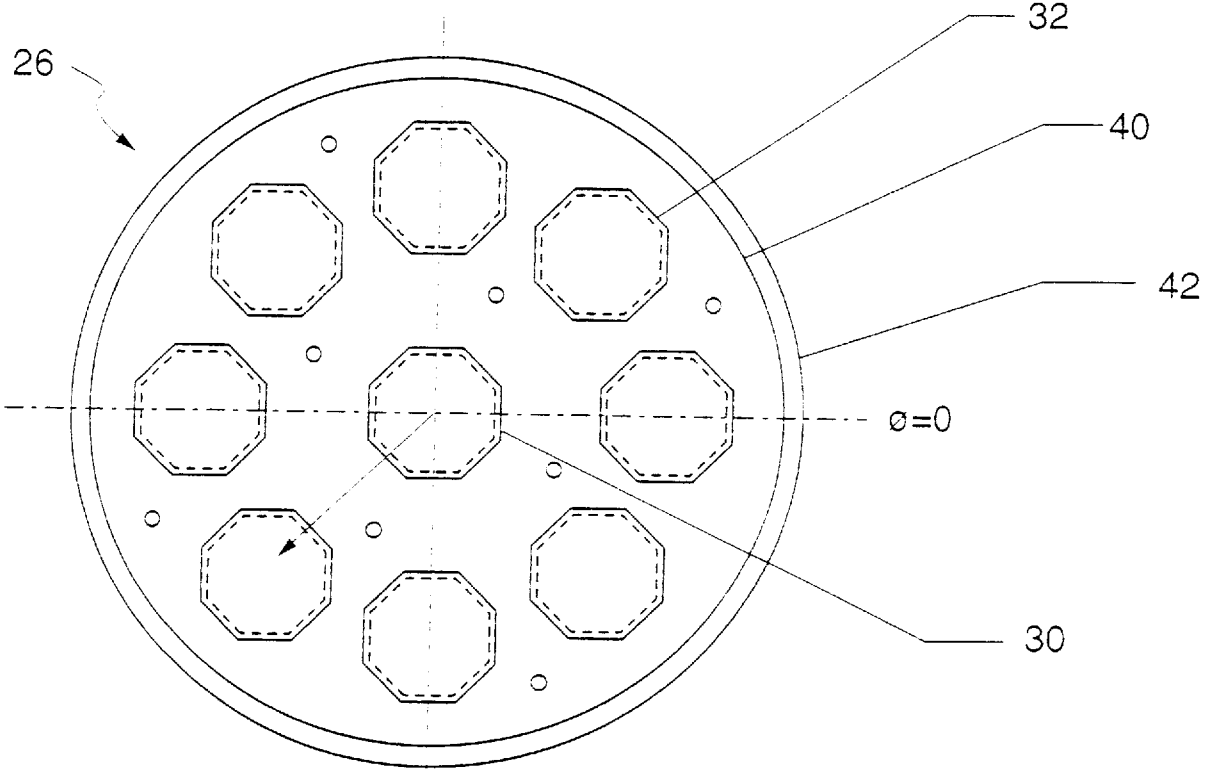
FIGS. 3A and 3B are a top and side view, respectively, of a center unit which may be used in the antenna system of the present invention.
Figure 3B:
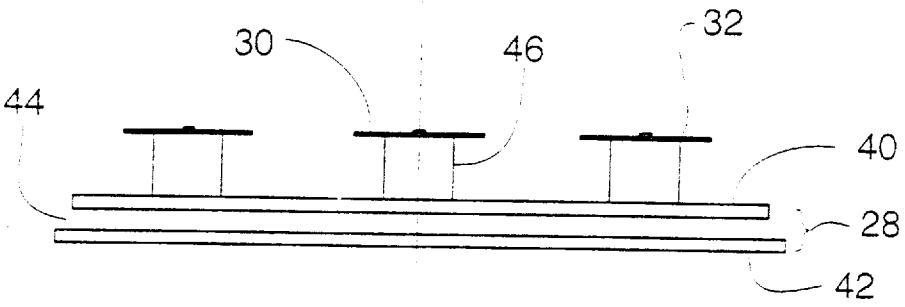

FIGS. 3A and 3B are a top view and side view, respectively, of the center section 26 of the antenna system 22 of FIG. 2. As illustrated in FIG. 3B, the center UHF element 28 comprises a stacked patch radiating element having an upper conductive plate 40 and a lower conductive plate 42. The two plates 40, 42 are substantially parallel to one another and are separated by a spacing 44 of substantially uniform thickness. If the stacked patch is being used in a transmit mode, an electromagnetic signal is delivered to a first of the two plates (i.e., the driven plate) and produces currents on this plate. The currents on the driven plate, in turn, create fields around the driven plate which induce currents on the second of the two plates (i.e., the parasitic plate). The fields created by the currents on the two plates then combine in the far-field to create a relatively high-gain antenna transmit beam in a direction perpendicular to the plane of the upper plate 40. If the stacked patch is being used in a receive mode, as in the preferred embodiment of the present invention, operation is substantially the reverse of the above. Either the upper plate 40 or the lower plate 42 can operate as the driven plate or, alternatively, both plates can operate as both driven plates and parasitic plates concurrently. In addition, further plates may be added to the stacked patch structure to obtain additional control over the impedance and bandwidth as well as the far-field pattern of the structure.

The center L-band element 30 and the inner L-band ring array 32 are situated on top of the upper conductive plate 40 of the stacked patch radiating element and use the upper plate 40 as a ground plane. As illustrated in FIG. 3A, center L-band element 30 is substantially centered on an upper surface of upper plate 40. The elements of the inner L-band ring array 32 are equally spaced at a radius $r_1$ from the center of the upper plate 40. In the preferred embodiment, the center L-band element 30 and each of the elements in the inner L-band ring array 32 comprise crossed dipole radiating elements implemented using microstrip transmission line. Microstrip crossed dipole elements are desirable because they exhibit relatively low mutual coupling with adjacent elements. The microstrip crossed dipole elements of the preferred embodiment are elevated above the upper conductive plate 40 using a support tube 46.

Figure 4B:
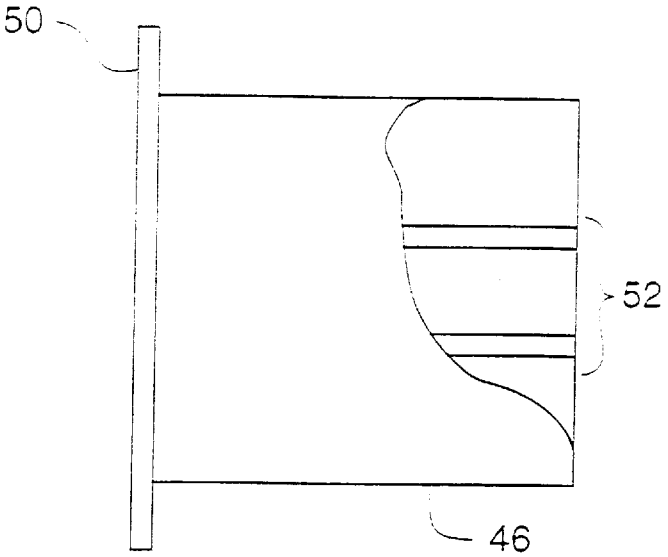
FIGS. 4A and 4B are a top and side view, respectively, of a crossed dipole antenna element which may be used in the antenna system of the present invention.
Figure 4A:
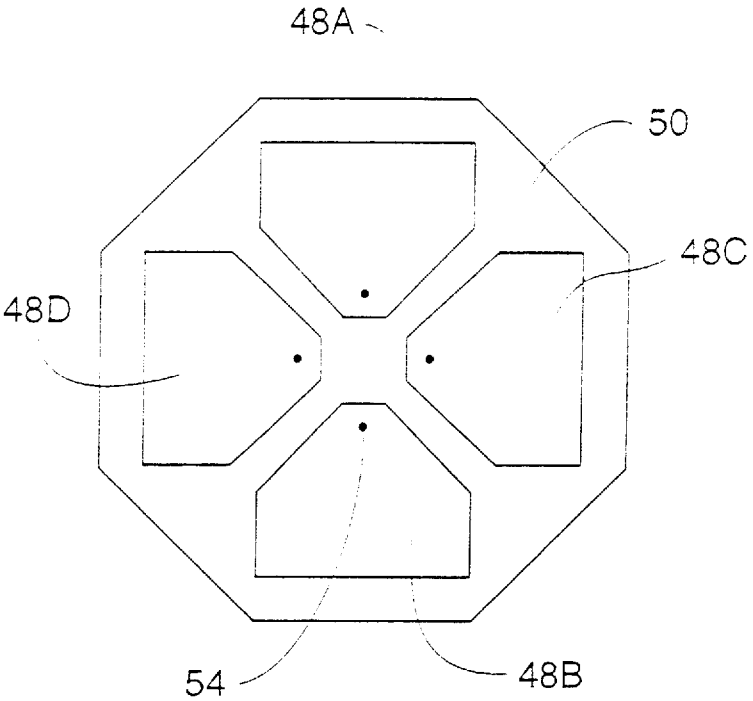

FIGS. 4A and 4B illustrate a top view and a side view, respectively, of one of the crossed dipole radiating elements. The elements each include four metallization regions 48A–48D disposed upon an upper surface of a substrate material 50. The metallization regions 48A–48D are fed by a balun structure 52 which extends through the support tube 46. To achieve circular polarization, quadrature hybrids (not shown) are used to create two balanced signals having a 90 degree phase difference therebetween. One of the balanced signals is delivered to first opposing regions 48A/48B and the other balanced signal is delivered to second opposing regions 48C/48D of the crossed dipole. The signals are fed to the respective metallization regions 48A–48D using feed pins 54 which extend through the substrate material 50.

In one embodiment of the present invention, the crossed dipole radiating elements are modularized (i.e., adapted for easy removal and replacement from the center unit 26). This modularization feature is useful during qualification testing of the antenna system 22 because it allows defective elements to be replaced right at the test site without having to detach the antenna system from the test equipment. The modularization of an element may make use of quick release feed connectors which provide both a signal flow path to/from the element and a means for holding the element to the upper conductive plate 40.

Figure 5:
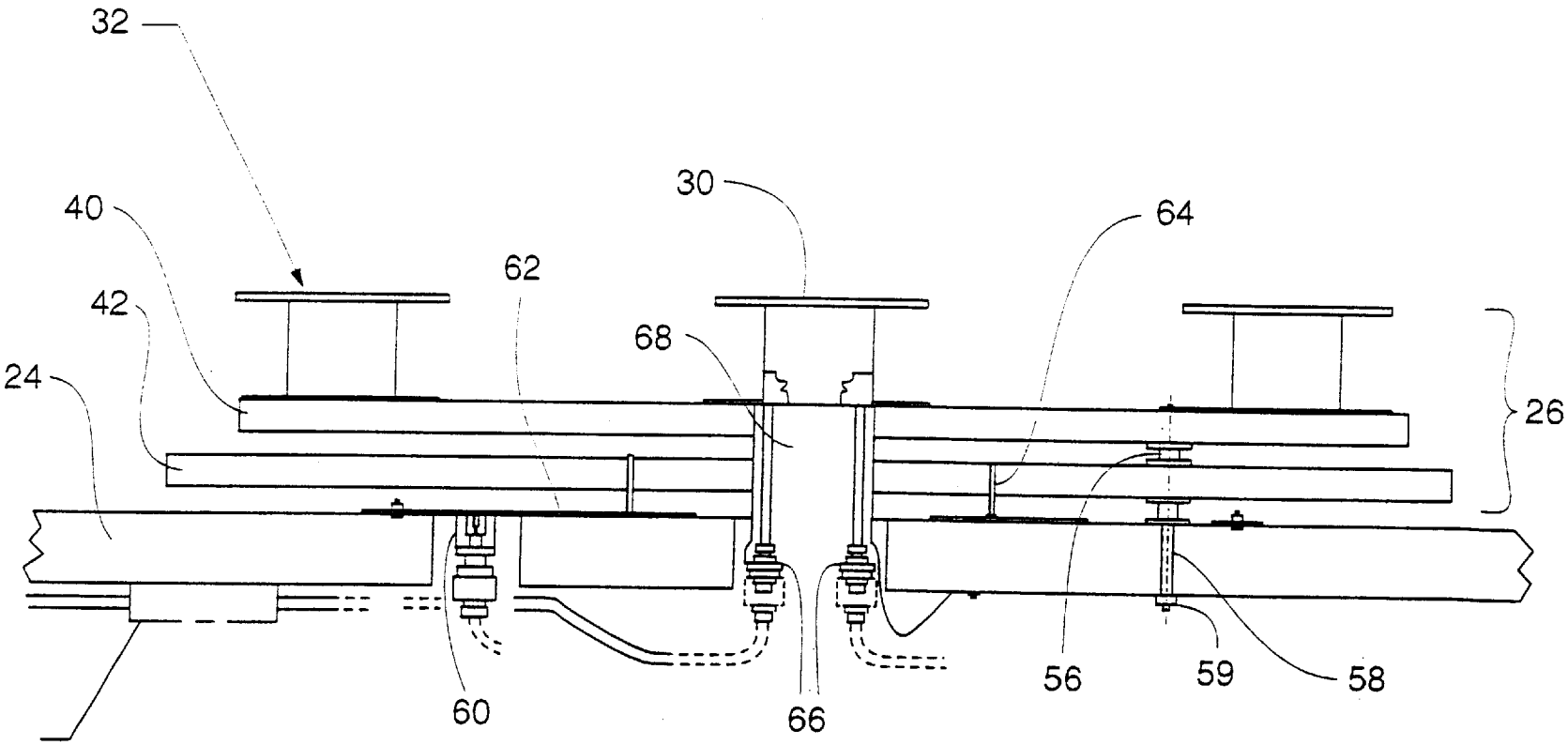
FIG. 5 is a side view of a center portion of the antenna system of FIG. 2.

FIG. 5 is a sectional side view illustrating the mechanical and electrical coupling between the center unit 26 and the rest of the antenna system 22 in one embodiment of the present invention. Dielectric standoffs 56 are used between the upper conductive plate 40 and the lower conductive plate 42 and between the lower conductive plate 42 and the support plate 24 to maintain substantially uniform spacings between these structures. The standoffs 56 are held in place, and the plates 40, 42, 24 are held together, by fastening means 58 (such as screws or bolts) placed through holes in the plates 40, 42, 24 and the standoffs 56 and second at a lower end by a nut 59 or other securing means. An electrical connector 60 is attached to the support plate 24 for providing a signal flow path to the center UHF element 28 (i.e., the stacked patch). The connector 60 is electrically connected to a UHF feed network 62 disposed upon an upper surface of the support plate 24 which receives signals from the stacked patch element through feed pins 64 connected to the lower conductive plate 42. Electrical connectors 66 are also used for providing a signal flow path to the L-band elements 30, 32 mounted on top of the upper conductive plate 40. The connectors 66 are coupled to transmission line sections which feed through a cylindrical channel 68 in the center of all three of the plate structures 24, 40, and 42.

Referring back to FIG. 2, the elements of the outer L-band ring array 34 are mounted directly to the support plate 24. As illustrated, the elements are equally spaced at a radius $r_2$ from the center of the aperture. In one embodiment, the elements of the outer L-band ring array 34 comprise crossed dipole elements substantially identical to the elements of the inner L-band ring array 32. In another embodiment, the elements comprise axial-mode helical antennas. The elements of the outer L-band ring array 34 may also be modularized as discussed above.

Figure 6B:
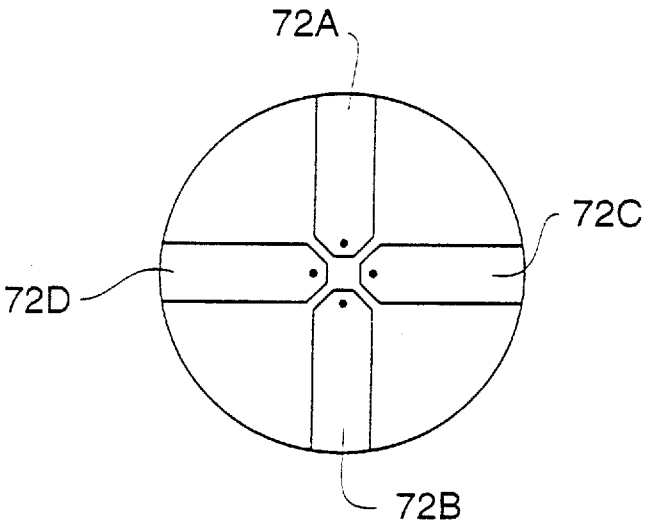
FIGS. 6A and 6B are a side and top view, respectively, of a quadrafilar helical antenna element which may be used in the antenna system of the present invention.
Figure 6A:
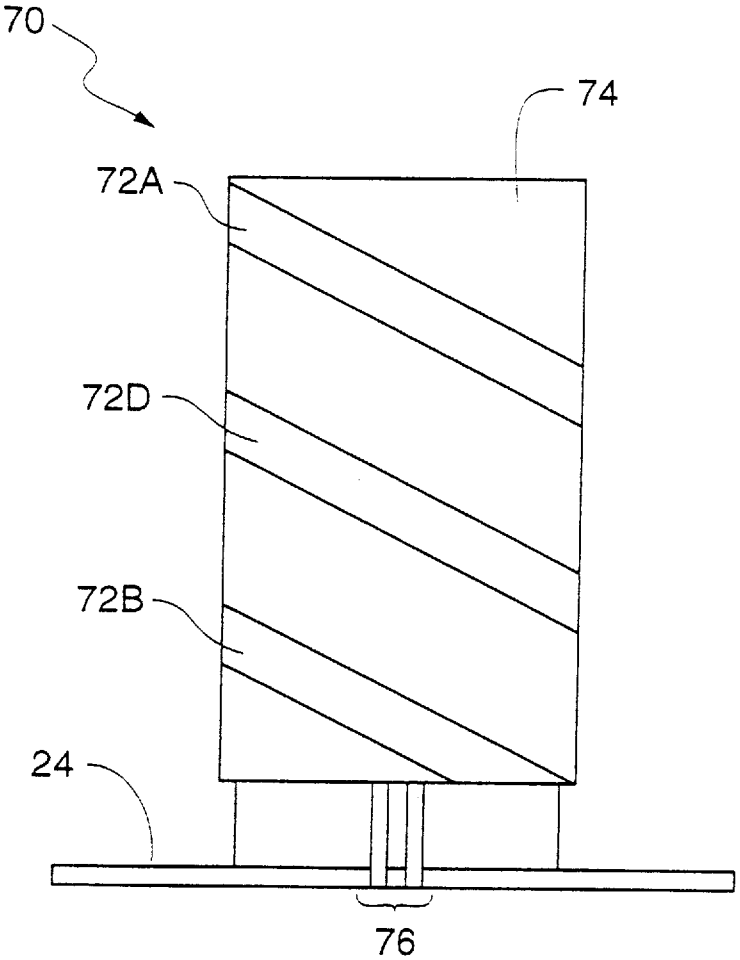

The elements of the UHF ring array 36 are also mounted directly to the support plate 24 and are equally spaced at a radius $r_3$ from the center of the aperture. In the preferred embodiment, the UHF ring array 36 comprises seven quadrafilar helical antenna elements, such as the one illustrated in FIGS. 6A and 6B. As illustrated in the figures, the quadrafilar helical antenna element 70 includes four conductive strips 72A–72D which are each wrapped around a cylindrical support structure 74 to form a helix. The strips 72A–72D are fed using a balun 76 extending through the center of the support structure 74. Quadrature hybrids (not shown) are used to create (or combine) two balanced signals having a 90-degree phase difference therebetween for application to the two pairs of opposing strips 72A/72B and 72C/72D. The hybrids may also be used to combine quadrature signals upon reception by the element 70. In this way, the antenna element 70 is capable of transmitting and/or receiving a circularly polarized electromagnetic wave. The cylindrical support structure 74 may include an epoxy fiberglass outer housing having a number of laminated epoxy fiberglass/honeycomb disks located therein for support. A laminated reinforcing hoop may also be placed at the base of the housing for further support. Such a support structure is very light weight yet provides a large degree of structural integrity without degrading RF performance.

Figure 7:
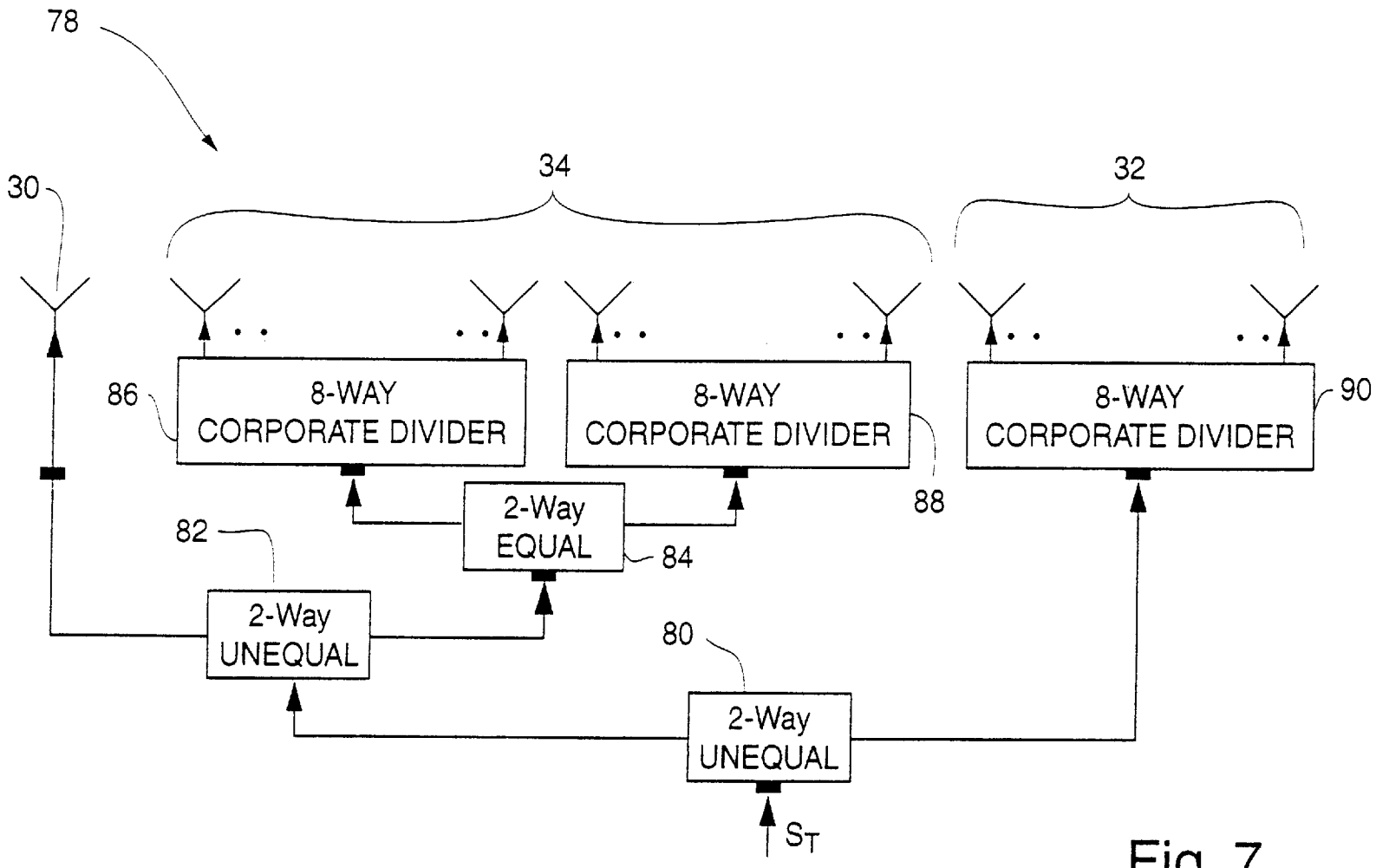
FIG. 7 is a block diagram of an L-band beamforming network which may be used in the antenna system of the present invention.

FIG. 7 illustrates an L-band beamforming network 78 which may be used in the antenna system 22 of FIG. 2. The network 78 includes a plurality of signal dividing means for use in distributing a single L-band transmit signal $S_T$ to all of the L-band antenna elements in the system 22. The beamforming network 78 includes: two 2-way unequal dividers 80, 82; one 2-way equal divider 84; and three 8-way corporate dividers 86, 88, 90. Eight-way corporate divider 90 is operative for receiving a signal at an input port and equally distributing that signal to the elements in the inner L-band ring array 32. Corporate divider 90 may be mounted on top of upper conductive plate 40 to conserve both space and weight while reducing RF loss. Weight is conserved because the eight transmission line sections leading from the divider to the elements are made as short as possible. Space is conserved because the divider can be designed to utilize real estate which otherwise would be vacant. Corporate dividers 90 can be implemented in microstrip transmission line using the upper conductive plate as a ground plane. Eight-way corporate dividers 86 and 88 are operative for receiving equal input signals at respective input ports and for equally distributing these signals to the 16 elements of the outer L-band ring array 34. These dividers 86, 88 are mounted on top of support plate 24. Two-way unequal divider 80 receives transmit signal $S_T$ at an input port and splits the signal into two unequal output signals. One of the output signals is delivered to 8-way divider 90 for delivery to the inner array 32 and the other is delivered to 2-way unequal divider 82. The signal delivered to divider 82 is split into two unequal output signals, one of which is delivered to the L-band center element 30 and one of which is delivered to the 2-way equal divider 84. The 2-way equal divider 84 is operative for dividing its input signal equally between the two 8-way dividers 86 and 88 associated with the outer L-band ring array 34. The split ratios of the 2 unequal dividers 80, 82 are chosen based on a predetermined optimal excitation ratio for achieving a desired antenna pattern.

Figure 8:
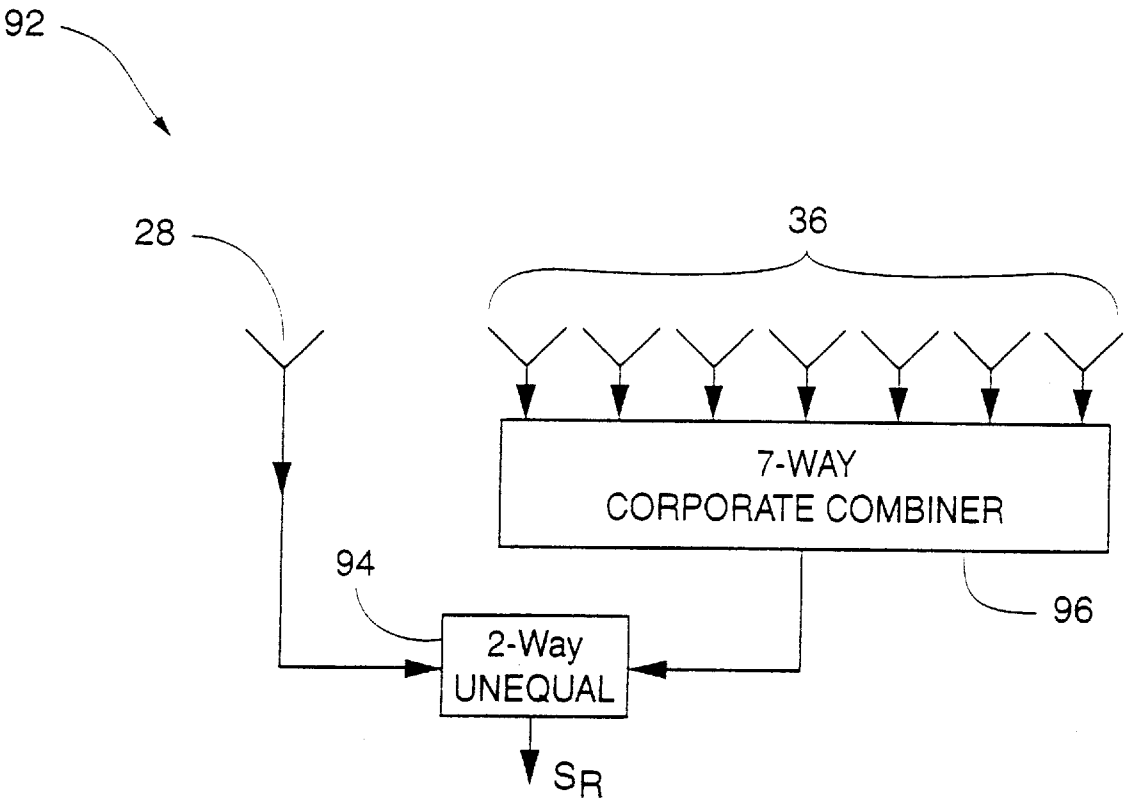
FIG. 8 is a block diagram of a UHF beamforming network which may be used in the antenna system of the present invention.

FIG. 8 illustrates a UHF beamforming network 92 which may be used in the antenna system 22 of FIG. 2. The network 92 includes 2-way unequal combiner 94 and 7-way corporate combiner 96. The 7-way corporate combiner 96 is operative for combining signals received from each of the elements in the UHF ring array 36. This signal is then combined with the signal received by the center UHF element 28, in 2-way unequal combiner 94, to create receive signal $S_R$. The combination ratio of 2-way unequal combiner 94 is chosen based on a predetermined optimal ratio for achieving a desired receive pattern. Both the 2-way unequal dividers 80, 82 and the two-way unequal combiner 94 can include split/combination ratios which vary with frequency across the associated frequency band.

As described above, the antenna system of the present invention provides a high degree of design freedom for achieving desired pattern shapes in each of its operational frequency bands. This is possible, in part, because the system may include a center element for each of the separate frequency bands. The use of a center element provides a symmetrical center beam which can be "molded" into a desired far-field pattern using the elements in the ring arrays. For each frequency band, design variables which affect the shaping of the far-field pattern include: element type(s) used in the ring arrays (must consider element pattern in array environment and mutual coupling between elements), number of elements in each ring array, number of ring arrays, distance between ring arrays, distance between center element and each ring array, excitation ratio between center element and elements in each ring array (can be frequency dependent), and phase relationship between center element and elements in each ring array. Using the above design variables, it is possible to independently adjust the patterns associated with each of the frequency bands to achieve substantially optimal ground coverage patterns across each band.

During the design phase on an antenna system in accordance with the present invention, it may be found that the phase difference between a center element and the elements of an associated ring array (or between the elements of a first ring array and the elements of a second ring array, etc.) has to vary in a predetermined manner across the band of interest to achieve the desired antenna pattern across the entire band. This could occur, for example, when the desired pattern requires a dip in the gain of the antenna at broadside. A problem arises in that optimization of the phase characteristics of the beamforming network at a first frequency in the band of interest may produce a suboptimal phase relationship at other frequencies in the band, resulting in a suboptimal pattern at these other frequencies. The following method may be used to "tune" the phase characteristics of an antenna system to better match the optimal antenna pattern across the band of interest. The method is only useful, however, in antenna arrays which utilize circularly polarized antenna elements.

The method recognizes that the phase relationships between the elements of an antenna system, such as the system described above, may be characterized as having both a frequency dependent component and a frequency independent component. In a system which comprises a first group of elements and a second group of elements, wherein the first group and the second group are concentrically arranged and all of the elements are circularly polarized, it is possible to achieve a constant phase difference between the elements of the first group and the elements of the second group by physically rotating each of the elements of one of the groups about an axis of that element. All of the elements in the group should be rotated an equal amount. The constant phase difference created by this procedure is frequency independent, i.e., it does not change across the frequency band.

There will be a frequency dependent phase difference between the elements of the first group and the elements of the second group whenever there is a difference in electrical path length between a common feed point and the elements of each respective group. By changing the magnitude of the difference in electrical path length (which can be done by adding a length of transmission line), the rate of the phase difference change with frequency (i.e., the phase slope) can be adjusted. Therefore, the method of tuning the phase characteristics of the antenna system comprises adjusting both the difference in path length and the physical orientation of the elements until the desired phase relationships exist between the elements of the first group and the elements of the second group.

Practically speaking, it is very difficult, if not impossible, to achieve optimal phase relationships across the entire band. In this regard, the adjustments to the antenna may be carried out so that optimal phase relationships exist only at the most important frequencies in the band of interest, such as at the band edges. This can be done by first choosing the difference in path length to achieve a desired phase slope and then using the constant phase difference created by element orientation as an offset to achieve the desired phase differences at each of the frequencies. The above-described method may be used for each of the frequency bands in the antenna system.

Although the present invention has been described in conjunction with its preferred embodiment, it is to be understood that modifications and variations may be resorted to without departing from the spirit and scope of the invention as those skilled in the art readily understand. For example, the antenna system of the present invention may be adapted for use in greater than two frequency bands. Also, each of the arrays in the antenna system may be used for both receiving and transmitting. Further adaptation of the system, such as by adding phase control means to the elements of the arrays, can result in steerable antenna patterns. Further, by providing separate beamforming means for various subarrays in one or more of the frequency bands, multiple steerable beams can be achieved in each band. Such modifications and variations are considered to be within the purview and scope of the invention and the appended claims.

What is claimed is:

1. A multi-frequency antenna apparatus, comprising:

a first array of antenna elements that includes a first group of antenna elements and a second group of antenna elements, said first group of antenna elements having a first central element located in substantially the center of said first array of elements and a first antenna aperture, said first group of said first array includes said first central element that is a first type of antenna element and each of said antenna elements of said second group of said first array is a second type of antenna element that is different from said first type and with said first central element being substantially greater in size than each of said second group of antenna elements of said first array and wherein each of said first and second groups of antenna elements of said first array operate in a first frequency range; and a second array of antenna elements having a second central element located in substantially the center of said second array of antenna elements and a second antenna aperture, said second array of antenna elements including a first group of antenna elements and a second group of antenna elements, said first group of said second array including said second central element, said second group of said second array including a plurality of antenna elements and with each spaced from said first group of said second array, each of said antenna elements of said first group and said second group of said second array, respectively, being mounted on and extending outwardly of said first central element such that a line defined normal to the plane of one antenna element of said second group of said second array and normal to the plane of said first central element passes through both said one antenna element and said first central element, each of said antenna elements of said first and second groups of antenna elements of said second array operating in a second frequency range, different from said first frequency range, wherein said first central element is substantially coaxially aligned with said second central element and said first antenna aperture and said second antenna aperture are at least partially overlapping.

2. The apparatus of claim 1, wherein:

said first central element comprises an upper conductive plate and a lower conductive plate; and said upper conductive plate of said first central element acts as a ground plane for said second central element.

3. The apparatus of claim 1, wherein:

said first central element includes a stacked patch element.

4. The apparatus of claim 1, wherein:

said first and second array communicate directly with free space substantially free of any intervening reflective surface.

5. The apparatus of claim 1, wherein:

said first group of antenna elements of said second array of antenna elements includes elements of a third type and said second group of antenna elements of said second array includes elements of a fourth type, wherein said fourth type is different from said third type.

6. The apparatus of claim 1, wherein:

said first type of element has a first antenna gain and said second type of element has a second antenna gain, wherein said first antenna gain is greater than said second antenna gain.

7. The apparatus of claim 1, wherein:

said first type of element comprises a stacked patch element.

8. The apparatus of claim 1, wherein:

said second type of element comprises a helical antenna element.

9. The apparatus of claim 5, wherein:

said third type of element comprises a dipole antenna element.

10. The apparatus of claim 5, wherein:

said fourth type of element comprises a helical antenna element.

11. The apparatus of claim 8, wherein:

said helical antenna element comprises a quadrafilar helix.

12. The apparatus of claim 10, wherein:

said helical antenna element comprises an axial mode helix.

13. The apparatus of claim 1, wherein:

said second group of antenna elements of said first array includes a first plurality of antenna elements arranged in a ring configuration positioned about said first central element, wherein said first plurality are fed by a first transmission line that does not feed any other elements in said first array.

14. The apparatus of claim 13, wherein:

said first plurality of antenna elements includes one or more helical antenna elements.

15. The apparatus of claim 13, further comprising:

beamforming means for feeding the elements of said first array according to a predetermined excitation ratio between said first plurality of antenna elements, that are arranged in said ring configuration about said first central element, and said first central element.

16. The apparatus of claim 15, wherein:

said beamforming means includes means for combining signals from said first plurality of antenna elements and a signal from said first central element according to said predetermined excitation ratio.

17. The apparatus of claim 15, wherein:

said beamforming means includes means for driving said first central element at a first power level and each of the elements of said first plurality of antenna elements, that are arranged in said ring configuration about said first central element, at a second, different power level according to said predetermined excitation ratio.

18. The apparatus of claim 15, wherein:

said beamforming means includes means for driving said first central element at a first excitation phase value and each of the elements of said first plurality of antenna elements, that are arranged in said ring configuration about said first central element, at a second, different excitation phase value.

19. The apparatus of claim 15, wherein:

said predetermined excitation ratio is determined based on a desired antenna pattern for said first array.

20. The apparatus of claim 13, wherein:

said second group of antenna elements of said second array includes a second plurality of antenna elements arranged in a ring configuration about said second central element, wherein said second plurality are fed by a second transmission line that does not feed any other elements in said second array.

21. The apparatus of claim 20, wherein:

said second plurality of antenna elements includes one or more dipole antenna elements.

22. The apparatus of claim 21, wherein:

said dipole antenna elements include crossed dipoles.

23. The apparatus of claim 20, wherein:

said second array further includes a third plurality of antenna elements arranged in a ring configuration about said second central element, wherein said third plurality are fed by a third transmission line that does not feed any other elements in said second array.

24. The apparatus of claim 23, wherein:

said third plurality of antenna elements includes one or more dipole antenna elements.

25. The apparatus of claim 23, wherein:

said third plurality of antenna elements includes one or more helical antenna elements.

26. The apparatus of claim 1, wherein:

each of said elements in said first array produces a circularly polarized beam.

27. The apparatus of claim 1, wherein:

said first central element includes an upper conductive plate and said second central element includes a dipole antenna element and in which said dipole antenna element comprises a crossed dipole antenna element capable of transmitting and receiving circularly polarized waves.

28. The apparatus of claim 1, wherein:

said first frequency range includes UHF.

29. The apparatus of claim 1, wherein:

said second frequency range includes L-band.

30. The apparatus of claim 27, wherein:

said dipole antenna element is at least partially air loaded to reduce weight of the apparatus.

31. The apparatus of claim 27, wherein:

said dipole antenna element is adapted for ready removal and replacement.

32. The apparatus of claim 27, wherein:

said crossed dipole antenna element further comprises a feed structure having a balun capable of converting a single-ended feed signal into a balanced feed signal for use in exciting said crossed dipole antenna element.

33. The apparatus of claim 27, wherein:

said crossed dipole antenna element further comprises a feed structure having a hybrid coupler capable of converting a feed signal into two signals having a 90-degree phase difference for use in exciting said crossed dipole.

34. The apparatus of claim 1, wherein:

said first central element includes an upper conductive plate and a lower conductive plate and in which said upper conductive plate is mounted above and in fixed relation to said lower conductive plate, wherein said upper conductive plate and said lower conductive plate are separated by a dielectrically loaded spacing of substantially uniform thickness.

35. The apparatus of claim 34, wherein:

said spacing is filled with air.

36. The apparatus of claim 1, wherein:

said first central element comprises a patch antenna element that includes upper and lower conductive plates.

37. The apparatus of claim 36, wherein:

said patch antenna element includes a feed structure for feeding a signal to one of the following: only said lower conductive plate, only said upper conductive plate, and both said lower conductive plate and said upper conductive plate.

38. The apparatus of claim 1, wherein:

said first central element includes a stacked patch antenna element and said second group of antenna elements of said first array are fed from below through an opening in said stacked patch antenna element, said opening extending through both an upper conductive plate and a lower conductive plate of said stacked patch antenna element.

39. The apparatus of claim 38, wherein:

said opening is substantially centered in said upper conductive plate and said lower conductive plate.

40. The apparatus of claim 1, further comprising:

signal divider/combiner means and in which said first central element includes an upper conductive plate having an upper surface, said divider/combiner means being disposed upon said upper surface of said upper conductive plate for use in feeding said antenna elements of said second group of antenna elements of said second array that are mounted upon said upper surface, wherein said divider/combiner means communicates with a signal source via a hole in the center of said upper conductive plate.

41. The apparatus of claim 1, further comprising:

signal divider/combiner means and in which said first central element includes an upper conductive plate, said signal divider/combiner means being implemented using microstrip transmission line, wherein said upper conductive plate acts as a ground plane for said microstrip transmission line.

* * * * *